US011478054B2

(12) United States Patent
Nolan Krouse

(10) Patent No.: US 11,478,054 B2
(45) Date of Patent: Oct. 25, 2022

(54) ROLLABLE AND FOLDABLE JEWELRY CASE WITH TANGLE FREE MAGNETIC ATTACHMENTS TO ROLL OR FOLD UP INTO REDUCED SIZE FOR CONVEYANCE OR STORAGE

(71) Applicant: Jordan Nolan Krouse, Los Angeles, CA (US)

(72) Inventor: Jordan Nolan Krouse, Los Angeles, CA (US)

(73) Assignee: The Blingsling, LLC, Los Angeles, CA (US)

( * ) Notice: Subject to any disclaimer, the term of this patent is extended or adjusted under 35 U.S.C. 154(b) by 274 days.

(21) Appl. No.: 16/602,444

(22) Filed: Oct. 7, 2019

(65) Prior Publication Data

US 2020/0113301 A1 Apr. 16, 2020

Related U.S. Application Data

(60) Provisional application No. 62/766,399, filed on Oct. 16, 2018.

(51) Int. Cl.

| | |
|---|---|
| ***A45C 11/16*** | (2006.01) |
| ***A45C 13/10*** | (2006.01) |
| ***A45C 7/00*** | (2006.01) |

(52) U.S. Cl.

CPC ..... *A45C 11/16* (2013.01); *A45C 7/0077* (2013.01); *A45C 13/103* (2013.01); *A45C 13/1069* (2013.01)

(58) Field of Classification Search

CPC ..... A45C 11/16; A45C 7/0077; A45C 13/103; A45C 13/1069; A45C 11/26

USPC ..... 206/6.1

See application file for complete search history.

(56) References Cited

U.S. PATENT DOCUMENTS

| | | | | |
|---|---|---|---|---|
| 1,094,009 A * | 4/1914 | Parkhurst | B25H 3/02 | 206/373 |
| 3,139,133 A * | 6/1964 | Spector | A45C 7/0095 | 190/111 |
| 4,210,244 A * | 7/1980 | Westrick | A45C 11/26 | 206/373 |

(Continued)

*Primary Examiner* — Ernesto A Grano

(74) *Attorney, Agent, or Firm* — Paul M. Denk

(57) ABSTRACT

A jewelry case with magnetic or Velcro attachment mechanisms, the case comprising a base material, a series of transverse straps provided approximately across the base material, the base material having magnetic material or Velcro provided therein, the straps having aligned magnetic material or Velcro provided therein, such that when the straps adjacent the base are folded over into closure, after jewelry has been laid on or around the magnets onto the base material, the magnetic straps hold the jewelry in position for roll up, or folding, and storage or transit of the jewelry case. The straps may be of differing lengths and numbers. A concealed compartment may be provided within the base material, on the inside or outside, and secured by a closure, such as a zipper, to conceal jewelry or other small personal items within the compartment, during usage. Various ties, straps or cords may be applied to the top edge of the base material, to hold the rolled up or folded case into closure, after usage. The cords and ties can also be used to suspend the bag when unfolded.

13 Claims, 7 Drawing Sheets

(56) References Cited

U.S. PATENT DOCUMENTS 4,401,219 A * 8/1983 Mink ..... A45C 7/0095 206/466
D276,004 S * 10/1984 Mink ..... D3/299
4,773,535 A * 9/1988 Cook ..... A45C 3/00 206/373
D300,399 S * 3/1989 Krugman ..... D6/514
4,901,464 A * 2/1990 Banoun ..... F41A 29/00 206/315.11
4,930,635 A * 6/1990 Hotchkiss ..... A45C 11/16 150/131
D323,065 S * 1/1992 Stricklin ..... D19/83
5,121,833 A * 6/1992 Lindsay ..... A45C 7/0095 206/18
5,209,344 A * 5/1993 Smith ..... A45C 7/0095 206/466
5,363,953 A * 11/1994 Carter ..... A45C 11/16 206/495
5,427,230 A * 6/1995 Mattox ..... A45C 11/16 206/478
5,671,849 A * 9/1997 Bacon ..... A47F 7/02 206/6.1
5,779,033 A * 7/1998 Roegner ..... A45C 11/16 206/6.1
5,890,587 A 4/1999 Roegner
5,971,612 A 10/1999 McAuslan
6,050,931 A * 4/2000 Russell ..... A61N 2/06 600/15
6,250,470 B1 * 6/2001 Mackenzie ..... A01K 97/08 190/109
6,267,277 B1 * 7/2001 Taylor ..... A45C 7/0095 206/350
6,513,692 B1 2/2003 Forgosh et al.
6,523,653 B2 * 2/2003 Roegner ..... A45C 3/00 190/109
6,587,022 B1 * 7/2003 Devine ..... A45F 5/00 206/350
7,028,870 B2 * 4/2006 Valdez-Campbell ..... A45C 7/0095 224/153
7,146,651 B1 * 12/2006 Lapin ..... A41D 19/01594 2/338
7,731,023 B1 * 6/2010 Lesch ..... A47G 1/12 206/6.1
7,735,645 B2 6/2010 Joyce et al.
7,817,002 B2 * 10/2010 Fullerton ..... A45F 5/02 335/306
8,312,990 B2 11/2012 Gaspari et al.
8,727,110 B2 5/2014 Walsh
8,851,089 B1 10/2014 Rogers
8,915,354 B1 12/2014 Smith
9,004,760 B2 4/2015 Tzortzis
9,115,969 B2 * 8/2015 Goodwin ..... F42B 39/02
9,439,488 B2 * 9/2016 Davis ..... A45C 13/002
9,597,789 B2 * 3/2017 Yoosefi ..... A45C 13/30
9,681,720 B2 * 6/2017 Davis ..... A45C 13/002
10,099,831 B2 10/2018 Egli
10,183,628 B2 * 1/2019 Mea ..... A45F 5/00
10,258,855 B1 * 4/2019 DiMartino ..... A63B 67/002
10,455,921 B2 * 10/2019 Kesler ..... A45C 7/0095
10,524,560 B2 * 1/2020 Hanson ..... A45C 7/0095
10,568,421 B2 * 2/2020 Felsenthal ..... A47G 29/00
2004/0016670 A1 * 1/2004 Lewand ..... A47G 1/12 206/459.5
2004/0173484 A1 * 9/2004 Bates ..... A41D 13/0012 206/349
2004/0222125 A1 * 11/2004 Meing ..... A45C 11/26 206/581
2006/0171606 A1 8/2006 Valentine
2007/0023304 A1 2/2007 Joyce et al.
2009/0140511 A1 * 6/2009 Pestl ..... B42D 3/10 281/31
2009/0151827 A1 * 6/2009 Thompson ..... B60J 11/06 150/154
2009/0230000 A1 9/2009 Sackos
2012/0012624 A1 * 1/2012 Marrero ..... A45F 5/021 224/183
2012/0125957 A1 5/2012 Barber
2012/0241329 A1 * 9/2012 Gaspari ..... A45C 7/0095 206/6.1
2013/0243354 A1 * 9/2013 Lytle ..... B65D 33/24 383/59
2013/0256159 A1 * 10/2013 Walsh ..... A47G 29/08 206/6.1
2014/0209487 A1 7/2014 Walsh
2015/0068993 A1 3/2015 Ye
2015/0122820 A1 * 5/2015 Whitley ..... A45C 13/10 220/528
2015/0230575 A1 * 8/2015 Gort ..... A45C 11/26 53/467
2015/0237938 A1 * 8/2015 O'Neill ..... B60P 7/0823 2/322
2015/0296944 A1 10/2015 LaCombe
2016/0128440 A1 5/2016 Wyner et al.
2017/0095047 A1 * 4/2017 Kim ..... B65D 31/12
2019/0254398 A1 * 8/2019 Davis ..... A45C 3/004

* cited by examiner

ROLLABLE AND FOLDABLE JEWELRY CASE WITH TANGLE FREE MAGNETIC ATTACHMENTS TO ROLL OR FOLD UP INTO REDUCED SIZE FOR CONVEYANCE OR STORAGE

CROSS-REFERENCE TO RELATED APPLICATION

This application is a non-provisional of the provisional patent application having Ser. No. 62/766,399, filed on Oct. 16, 2018.

FIELD OF THE INVENTION

This invention is designed to provide a convenient transport means for jewelry that can be quickly and easily applied for storing jewelry, using a minimum of space, and to achieve such, the jewelry case is rollable, and/or foldable, into a more condensed form, and which holds the various pieces of jewelry untangled, protected, and confined, to prevent slippage or lost, during usage, utilizing magnetic attraction to hold the various components together.

BACKGROUND OF THE INVENTION

There have been numerous apparatuses and devices that have been developed, used, and applied, for generally displaying and providing storage for jewelry and other personal items. For example, U.S. Pat. No. 8,312,990, shows an accessory display and storage system, rather complex of structure, for precisely locating and holding a variety of jewelry and accessories, primarily for display purposes. Notwithstanding, even when the system as shown in said patent is folded, it still utilizes a significant amount of space, and would prevent the shown device from adding convenience, as when traveling, during application and usage.

U.S. Pat. No. 8,915,354, to Smith, shows a device for arranging and storing jewelry having organizing clasps. As noted, it is a foldable and collapsible jewelry storage device, and which may be hung by a hanger at its upper end, apparently during usage. But, once again, because of its size, even if it should be folded, it would take up significant room, and probably not fit too well within luggage, in preparation for travel.

The United States patent to Rogers, U.S. Pat. No. 8,851,089, shows an expandable travel bag system. This system appears to be more available for holding various cosmetics, brushes, and the like, within a foldable device, defined as an expandable travel bag, for usage. Does not insure tangle free support of items.

The patent to Walsh, U.S. Pat. No. 8,727,110, shows a jewelry organizing storage system, that may be hung from a door, and appears to be of significant size, for application to the door, and rolled up during storage, but can be released, apparently from its various Velcro attachments, for suspension, down the door, during usage. The patent does state that this storage organizer can be used for storing, or travel, with a large variety of jewelry. But, it would appear that the size of the device as shown, may not fit too well within luggage, even when rolled up, as noted.

The United States patent to Joice, et al., U.S. Pat. No. 7,735,645, does show a magnetic tool organizing system and method of manufacturing a magnetic tool organizing system. This device does use magnets, for holding tools to the base substrate of its organizing system. This device is not for completely and securely holding jewelry.

The United States patent to Valdez-Campbell, U.S. Pat. No. 7,028,870, shows a flexible foldable multi-article storage carrier. Apparently, this device may be used for storing a variety of dolls, such as for a child, and includes a plurality of compartments for use for holding such items.

The patent to Forgosh, U.S. Pat. No. 6,513,692, shows a form of roll carrier luggage device.

The patent to McAuslen, U.S. Pat. No. 5,971,612, shows coilable individual storage device.

The patent to Regner, U.S. Pat. No. 5,890,587, shows another form of various flapped and pocketed type of jewelry case.

The published application to LaComb, No. US 2015/0296944, shows a daily pocketed jewelry coordinator.

The published application to Gordon, No. US 2015/0230575, shows a jewelry organizer formed of rubberized material that apparently has a series of connecting points for holding jewelry, as noted, and which can be rolled up when put away during non-usage.

The published application to Ye, No. US 2015/0068993, shows a very large type of jewelry organizer.

The published application to Walsh, No. US 2014/029487, shows another form of jewelry organizing storage system.

The patent to Egil, U.S. Pat. No. 10,099,831, shows another form of storage system, using various types of straps, and clasps, for apparently holding the jewelry in place. This system is obviously time consuming of usage.

The published application to Barber, No. US 2012/0125957, shows another form of multi-purpose organizer and handled transporting device.

The published application to Meng, No. US 2004/0222125, shows another form of large travel bag, which when unfolded, can be suspended from a hanger, as noted.

The foregoing are examples of the various types of prior art cases, pouches, and bags, that are known, some for holding jewelry, primarily for storage, but some may be folded up and used for travel, albeit many of them appear to roll up into a sizable form, which makes them difficult for locating within the standard type of luggage, normally used nowadays for travel.

However, none of the items in the prior art cited above are able to keep the entirety of the jewelry, particularly necklaces, free of tangles, which makes this invention unique in that it is able to do so.

SUMMARY OF THE INVENTION

This invention contemplates the formation of a jewelry carrier, roll or bag device, that provides a series of straps that are generally magnetically held to a base material, through the use of magnets, or Velcro, but can be partially released, to allow for the application of earrings, with regard to one strap, rings, with regard to another strap, and to locate and hold various other items of jewelry, such as necklaces, bracelets, watches, or other related items, where the various straps are magnetically or with Velcro, applied to their bases, to hold such jewelry, when prepared for closing, zipping, folding or roll up, and eventual travel or storage.

This jewelry roll device is comprised of a main piece of fabric, defined as a base material, which is lined on one side with a protective material, which may be conveniently formed of attractive type of material, such as velvet, or other coordinated colored materials, (such as to bring out the theme of locations, such as Tuscany, Paris, London, Aruba, or other designs) that equally furnish a more attractive display, upon the underside of the base material, so that when the device is rolled up, zipped, folded, or closed, for transit, such colorations add to the attractiveness of the usable case, during its application and protect jewelry during usage.

The jewelry roll or device, and its base material, may be approximately 14 to 18 inches high, and 12 to 14, or more of width, so that when it is rolled up or folded during usage, it is far more compact for conveyance and storage. In the preferred embodiment, it has four straps incorporating magnets across the underside of the strap and base fabrics, and a pair of magnets towards the top of the base materiel, and the four straps have magnets applied inside of their formation, and which line up, or are aligned with magnets that are applied within the base material, between the velvet or related material that form the exterior of the base, and the related type of material that attractively forms the interior surface of the device, when unrolled for usage. The magnets within the straps are aligned with the magnets within the base material, and they are sewn within such material, or applied by other means, such as adhesive, so that when the straps are applied across the base material, after jewelry has been aligned and placed under the straps, the magnets in the base attract the magnets in the straps, and hold the jewelry in place, during usage of the jewelry roll. Velcro may also be used.

At the top of the jewelry case or roll, there are two shorter straps, and one or more magnets or Velcro provided within the smaller straps, and embedded in the base material, so that when the smaller straps are applied against the base, after earrings, rings, or the like, are applied thereto, they will be held in position by means of the various aligned magnets or Velcro, during application. Or, since these straps are shorter, there may be a clasp at the inner ends of these smaller straps, that connect with the corresponding clasp such as a snap applied to the base material, and aligned therewith, for holding the shorter straps in position, during usage of the device.

Above one or more of the various transverse straps, that generally extend from one side edge to the other side edge of the base material, there may be formed some pockets, within the base material, to provide further and more concealed storage of jewelry, during usage. Such pockets can be closed either by zippers, hook and pile fastening means, such as Velcro, buttons, magnets, and the like.

Generally, the tops of all straps are lined with a light foam or padding, to avoid connecting of the straps to each other, when the fabric is rolled. It is desirable not to have the top of the magnets interfere with each other, and attract each other, so as to prevent the opening of the straps, as it is used.

It is desirable to have some type of a hooking means at the top of the base material, rather it be elastic cords to hang around the ends of a hanger, a tie or a hook member similarly to the upper part of a hanger, or the like, to allow the device to be hung, and to display its jewelry, when the bag is unfolded. The hook can swivel inside of the roll, when it is folded or rolled up, and closed.

In addition, along the top edge of the base material, on both sides of the swivel hook or ties, there may be fabric ties and/or cords, which may also be of elastic formation, in order to wrap around the rolled up device, to hold it in its rolled position, as during non-usage. Alternatively, it can fold and/or zipper closed.

At the top of the bag, and underneath of the inner fabric forming the inner surface of the base material, there may be a layer of form or padding to hold the shape when the jewelry case is hanging, and the batting, may be thin enough to allow the entire device to be rolled up and/or folded, during usage, even while holding a variety of personal items of jewelry, during usage.

The preferred embodiment, the concept of this invention is to use a series of straps applied to a base material, holding the straps in position by means of aligned magnets, whereby the straps are all generally horizontally or vertically aligned, usually secured at one side as to an edge of the base material, and then such straps will be aligned so that it can be condensed into a much smaller configuration, without the entanglement of its held jewelry, when it is condensed for application into luggage, a purse, and other means for conveyance, during its application and usage. Then, when the user arrives at their destination, the case can be simply taken from its means of conveyance, unfolded, unzipped or unrolled, for ready access to its held jewelry, during usage.

This jewelry device is for use for transporting jewelry from one location to another, as during travel, but yet utilizes minimal space that keeps all the items organized and untangled, even when the device is rolled up or folded, and located into a suitcase, during usage. It can even be folded, to lie in a more flat configuration, to be applied to the bottom of the suitcase, or packed on the top of the contents, or, as noted, it can be rolled and folded to fit in empty corners or small pockets of a piece of luggage. The fabric forming the device, and its base material, is strong enough to protect the jewelry against damage, but thin enough to be flexible, rollable, and foldable. The magnetic or Velcro straps essentially keep the jewelry in place, tangle-free, and can be adjusted to add jewelry quickly to the device, in preparation for its usage.

Some of the attributes and the quality of the jewelry roll of this invention can be itemized, as follows:

1. Bag has overall polished/high-end look
2. Bag is slim and foldable
3. $1^{st}$ cotton pattern on outside, $2^{nd}$ cotton pattern underneath straps, $3^{rd}$ ultra-suede on inside of roll, $4^{th}$ faux leather for earring strap are all correct
4. Patterns sewn in correct directions (i.e.: horizontal stripes or flamingos up/down)
5. Bag has rounded corners, but can be made with squared edges
6. Batting to line outer layer for support
7. Earring strap folded/padded to be stiff
8. Earring strap has space on left side before holes are started
9. Earring strap has two rows of holes for total of 16 (or 8 pairs)
10. Earring and ring straps are pointed at inner ends
11. Earring and ring straps are directly under pouch for dangling earrings' space
12. Both small straps are correct lengths and even
13. Ring strap is padded with foam to be cylindrical shaped
14. Ring strap is small enough for size 4.5 ring, or larger
15. Snaps are used on both small straps
16. Snaps on both sides are small enough to fit size 4.5 ring over them
17. Snaps are strong enough to hold straps closed
18. Snaps are lights strength and should not tear ultra-suede
19. Zippered pouch is at top with same fabric as outer bag and tops of straps
20. Zipper is invisible but matches fabric
21. Zippered pouch is correct size and big enough to fit bangle bracelet 22. 4 straps with 4 magnets underneath zippered pouch and small straps
23. Straps have batting on top to help avoid straps connecting together when rolled
24. Straps have straight edges on all sides
25. Straps are rounded at the corners
26. Straps are inside bag when rolled
27. Straps are correct length and even to each other
28. Straps' magnets connect to each other matching magnet underneath ultra-suede
29. Magnets are strong enough to hold jewelry in place (N35)
30. Magnets do not tear through ultra-suede
31. Magnets are secure in straps and in main piece and do not move
32. Bag is 15"×14" when unrolled
33. Bag is 14"×3" when rolled
34. Tie is made of matching fabric to the outer bag or to underside of straps
35. Tie is 16" to wrap around twice and tie in bow
36. 2 elastic loops are 6" to hold bag closed
37. 2 elastic loops do not bunch jewelry roll when closed
38. 2 elastic loops are at equal ends of roll
39. 2 elastic loops can hang bag on hanger
40. Label is secured on ends
41. Label is placed on outside lower right corner of unrolled bag
42. All white trims match (elastic, zipper, earring strap) each other and with fabric.

It is, therefore, the principal object of this invention to provide a unique jewelry roll, or case, to which personal items of jewelry can be promptly applied, the device rolled up, zipped, folded or closed, held in its closed position, for application to luggage, or for conveyance, during travel or for other applications.

Still another object of this invention is to provide a series of straps, applied to a base material, with aligned magnets or Velcro in each, to provide for adherence of the straps, to its base, after jewelry has been applied thereto, or when the strap is to be opened, simply by release of its magnetic or Velcro attraction, in order to remove jewelry for usage, during application of the device.

A further object of this invention is to provide the application of smaller straps, that may be magnetically held in position, or clasped at their inner ends, and which when opened, can have earrings applied to a strap, or have rings applied to another short strap, to allow for their storage, when the jewelry case or roll is closed in preparation for transit.

A further object of this invention is to provide a cord or tie means at the upper end of the base material, so that the jewelry roll, when unrolled, can be suspended from a hook, hanger, closet bar, or other means of support, during usage.

Yet another object of this invention is to provide the use an elastic cord, zipper, and/or tie means, for adhering around the ends of the closed jewelry case, in preparation for its storage or transit.

A further object of this invention is the use of round or button magnets, other shaped magnets, or even magnetic doped vinyl, within straps and aligned base material, to secure the straps in place, during usage of the device. Velcro may be used instead of magnets.

These and other objects may become apparent to those skilled in the art upon review of the summary of the invention as provided herein, and upon undertaking a study of the description of its preferred embodiments.

DESCRIPTION OF THE PREFERRED EMBODIMENTS

Figure 1:
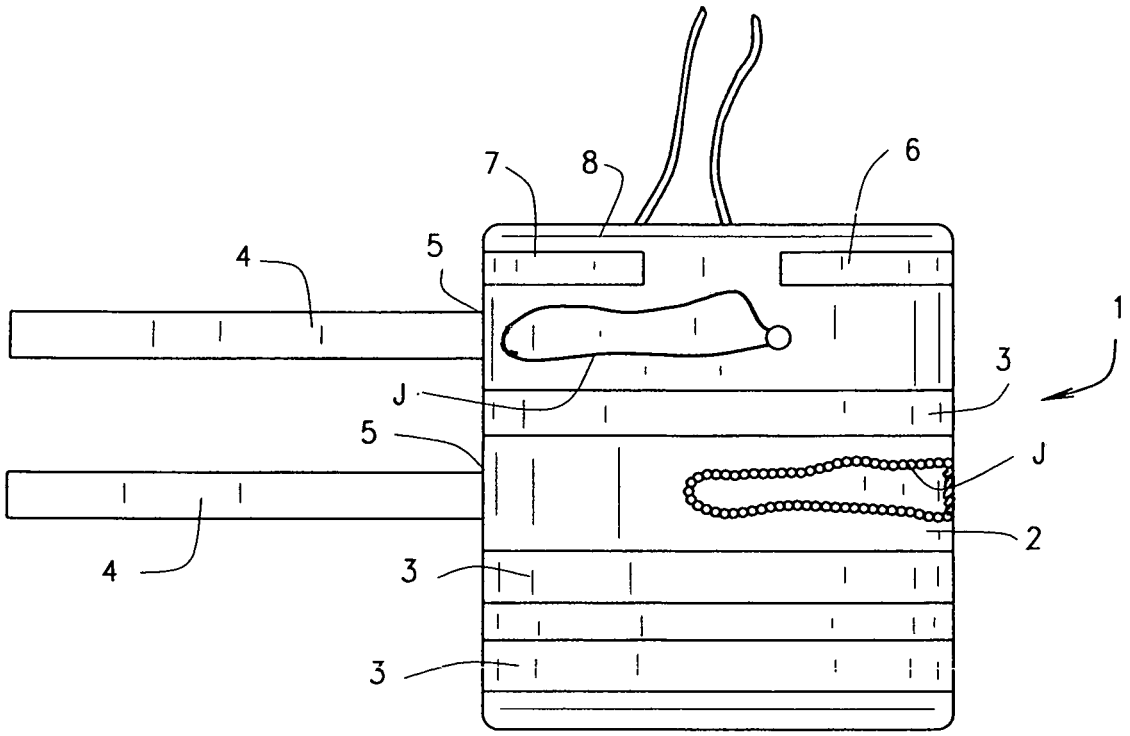
FIG. 1 shows an isometric view of the jewelry case of this invention, with a pair of its transverse straps located laterally, showing how necklaces, or the like, can be applied on the base material, and help in position when the transverse straps are folded into closure overlying said base.

In referring to the drawings, and in particular FIG. 1, therein is shown the jewelry case or roll 1 of this invention. It includes a base material, as at 2, and has a plurality of transverse straps, as noted generally at 3, applied across the base material, and which are held in position by means of magnets, or clasp, as to be subsequently described. As can be seen, when the transverse straps are released from the base material, albeit they are pivotally connected at their inner ends 5, their magnetic attraction to the magnets of the base material is broken, so that items of jewelry, such as the necklaces shown at J, can be applied to the base material, in preparation for the refolding of the straps 4 back over said base material, being magnetically attracted to the same, in order to hold the necklaces in place, as can be understood. As can also be seen, there are a pair of shorten straps 6 and 7, and these straps can be fabricated, as in the case of strap number 6, which not only includes magnets, or may have a clasp applied to its inner end, to hold rings in place, for storage or transit. And, to assure that the rings will be held into position, some bulk material, such as foam, may have been stitched into the strap 6, to accommodate and hold the rings in position. The base material may be a double layer of material and have its aligned magnets located intermediate or embedded therein.

In addition, the short strap 7 may have a series of apertures, as at 8, to which earrings may be applied, such as earrings for pierced ears, that can be held to that strap, during storage.

While the various long and short straps as previously defined for this invention are explained as being transversely located, it is just as likely that all of the straps could also be attached to the upper or lower edges of the base material, or vertically aligned, in their preparation for usage. But, the object of the invention is that regardless in which position the various straps are either horizontally aligned, or vertically aligned, the case will then be folded, rolled or zipper perpendicularly with respect to the location of the aligned straps, to facilitate the closure of the jewelry case during its application and usage, and prevent the jewelry from being entangled within the case when the jewelry is stored and being conveyed.

Figure 2:
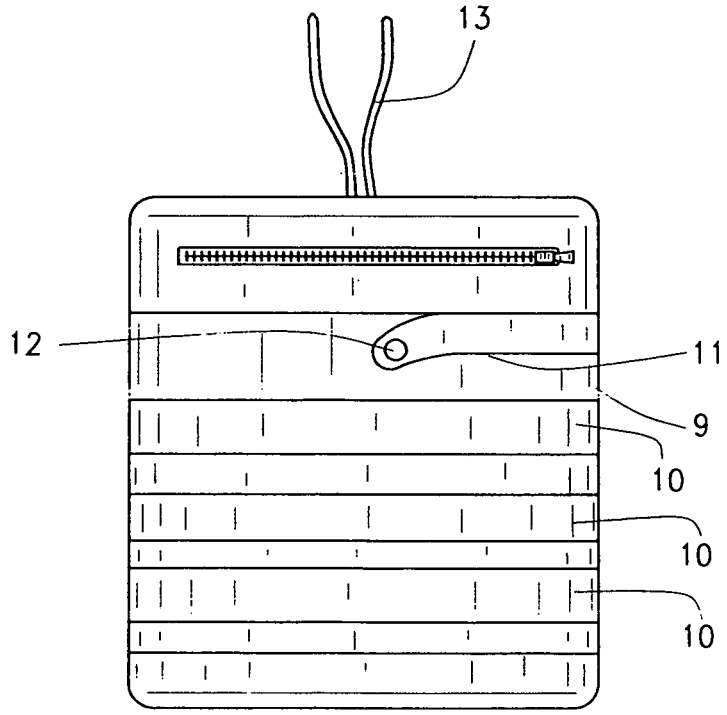
FIG. 2 shows an isometric view of the jewelry case with all of its various aligned straps applied into their operative position, generally located transversely upon its base material.

As can be seen in FIG. 2, the base material, in this instance, as noted at 9, has the series of transverse straps 10 applied thereto, and held into position by magnets, to be subsequently defined. In addition, the short strap 11 that may be used for holding rings, or earrings, may be clasped into position, the clasp being noted at 12. Furthermore, there may be a tie means, as noted at 13, provided at the central upper portion of the base material, and may be formed of a pair of ribbons or ties, so that the ribbons can be draped around some form of holder, such as a hook on a door, or wall, or be tied onto a closet rail or rod, and tied in position, as can be understood. These ties can also be used for securing the case when rolled up into closure.

Figure 3:
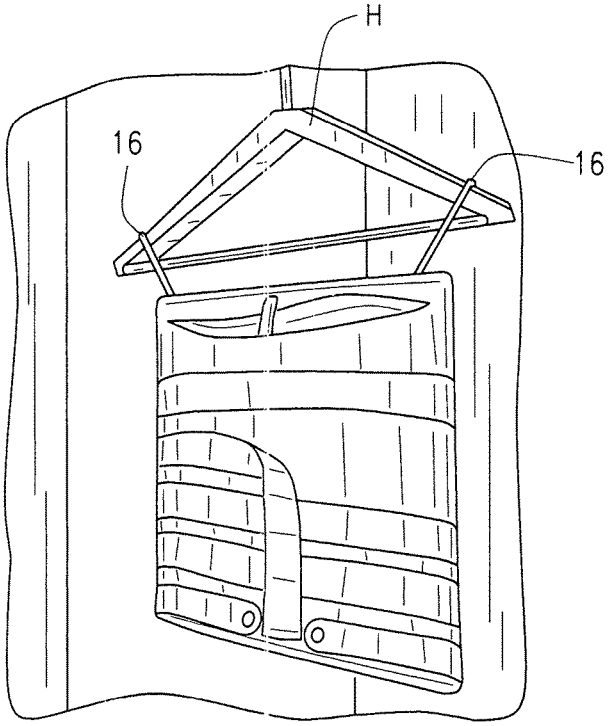
FIG. 3 shows how the jewelry case through its lateral cords, which may be elastic, can be applied onto the edges of a hanger, for support within a closet or other location.

FIG. 3 shows how the device of FIG. 2 may include a pair of cords, as can be seen at 13 or 16, and these may be formed of elastic material, so they can be draped over the ends of a clothes hanger, and help into position upon a closet rod, door hook, or other means for suspending the hanger in position, and its supported jewelry case, as noted.

Figure 4:
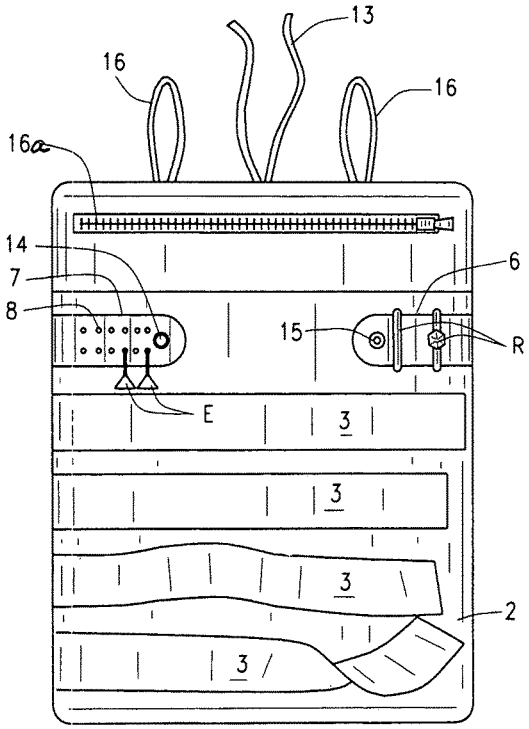
FIG. 4 provides a front view of the entire jewelry case, showing the location of its various transverse straps, short straps, a zipper for a formed pouch integrally within the base material, and disclosing its elastic cords, and the center arranged ribbons, that can be also used to hold the jewelry roll in closure, or applied onto a closet bar.

FIG. 4 does provide a front view of the jewelry case or roll 1 of this invention. The lateral straps 3 can be noted. In addition, the short strap 7 with its various apertures 8, are provided for holding earrings in place. To facilitate the application of earrings, as noted at E, the short strap may be held by magnets, or by a clasp, as can be seen at 14. The clasp will secure with a corresponding snap or clasp that is applied to the base material 2. Also it can be seen the short strap 6 that is designed for holding rings, as at R, can be noted. This particular short strap may also be held by a magnet, or a snap or clasp, as noted at 15.

In addition, this particular roll 1 may include an interior hidden pocket, within its base material, and it may be accessed through the opening of the zipper or other fastener 16*a*, to allow for a more concealed application of jewelry, to the jewelry roll or case, during usage. In addition, the ribbon or tie like material 13 can be seen extending upwardly generally centrally from the top of the base material 2, and the elastic cords 16 that may be used for embracing the ends of a hanger, as noted in FIG. 3 at H, as previously explained, and as can be seen. In addition, these elastic cords 16, when the jewelry case is rolled up into a compact position, can be stretched over the ends of the roll case, to secure it in its closed position, as during conveyance or storage.

As can also be understood, in the formation of the transverse straps 3, and even the short straps, when they are magnetically held in position, there may be matting applied within the straps on top of the magnets located therein so that when the case is rolled up, the various magnets from the various straps do not adhere to each other, which may break the transverse straps free from their securement, of jewelry, as the case is unrolled. The matting functions as an insulator against magnetic attraction, with respect to the various magnets positioned within the carrier, during its usage.

Figure 5:
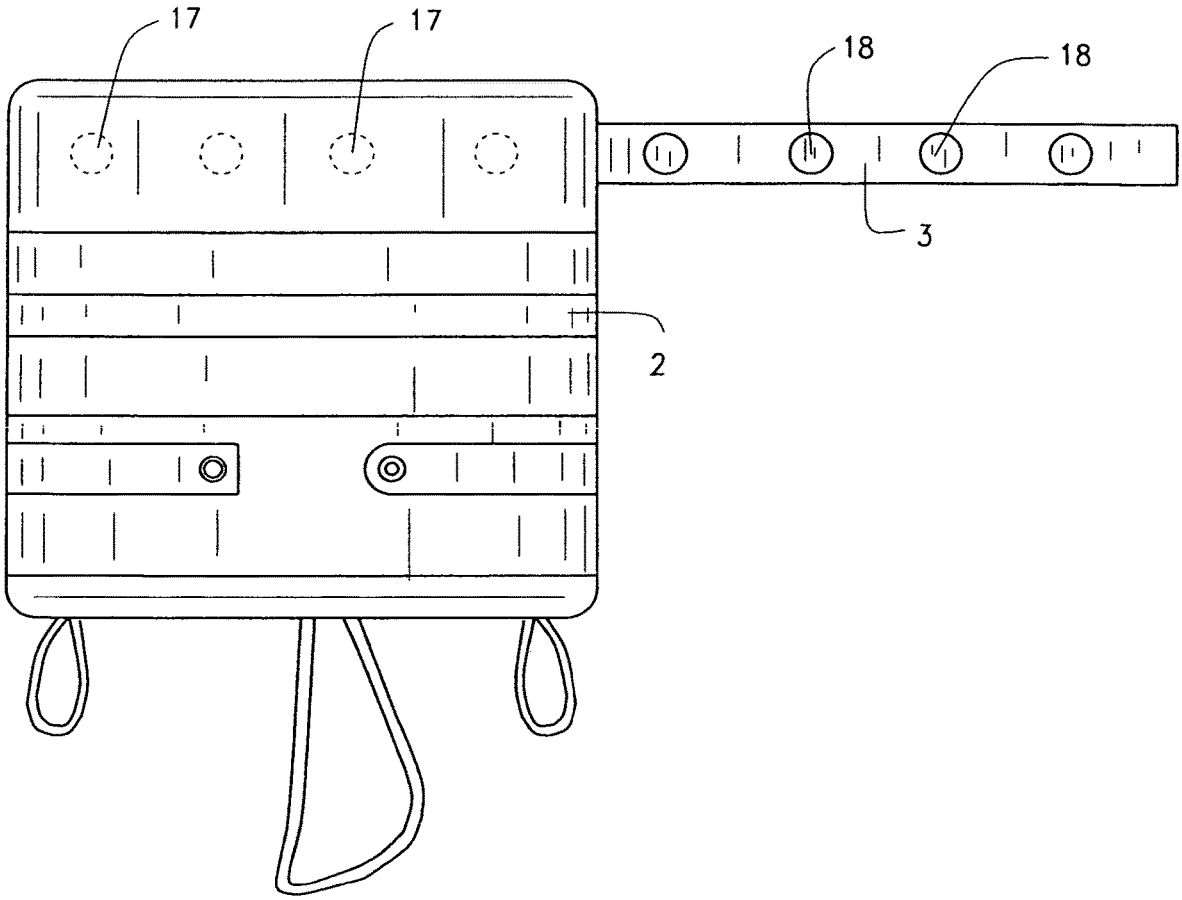
FIG. 5 provides an inverted view of the front of the jewelry case.

FIG. 5 shows how the base material 2 of the jewelry carrier has series of magnets 17 applied therein. In addition, the transverse strap 3 also has its series of magnets 18 applied therein. Thus, as can be seen, when the transverse straps are folded over into closure, after items of jewelry, such as necklaces, have been placed over the base material 2, on or surrounding the various magnets 17, the strap magnets 18 align with and adhere to their respective base magnets 17, to secure the straps in position, and to hold the items of jewelry in place, during usage.

Figure 6:
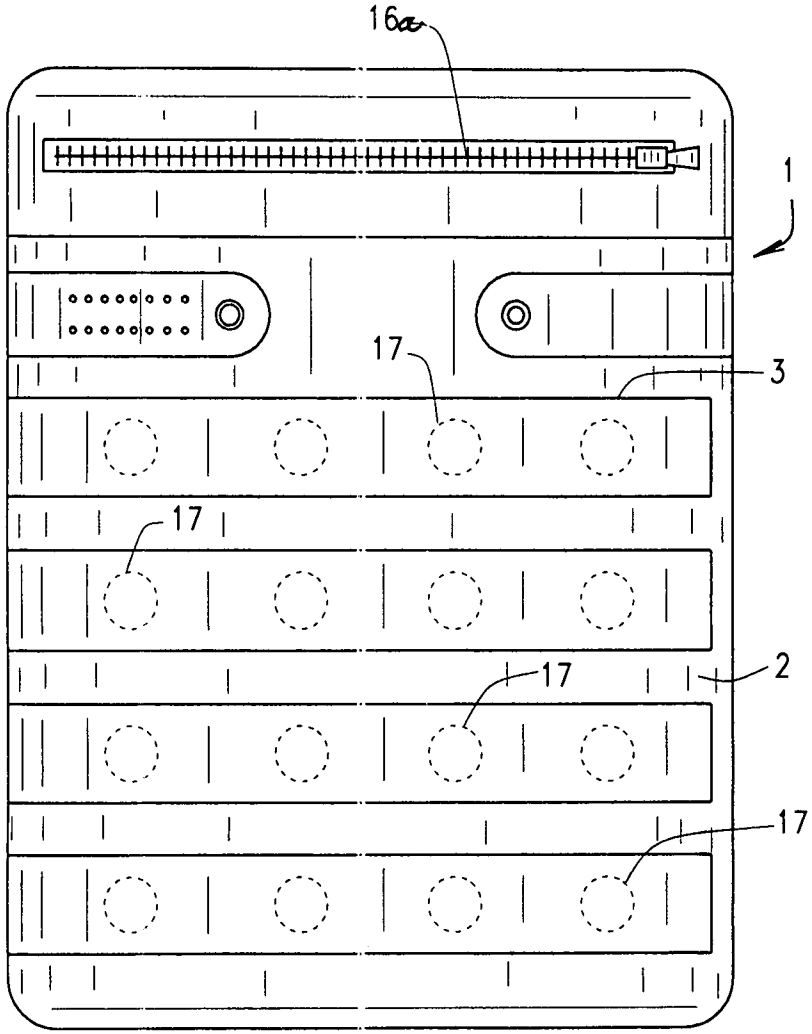
FIG. 6 provides a front view of the jewelry case or roll, and showing its long and short straps, and where magnets may locate interiorly of its straps, for alignment with related magnets applied into the base material, in order to hold the straps in position, when ladened with personal items of jewelry.

FIG. 6 shows the base material 2 of the jewelry roll or bag 1 and how the various straps 3 have their spaced magnets 17 applied within said straps. Also, the zipper 16 leading into the concealed compartment, within the base material 2, can be noted.

Figure 7:
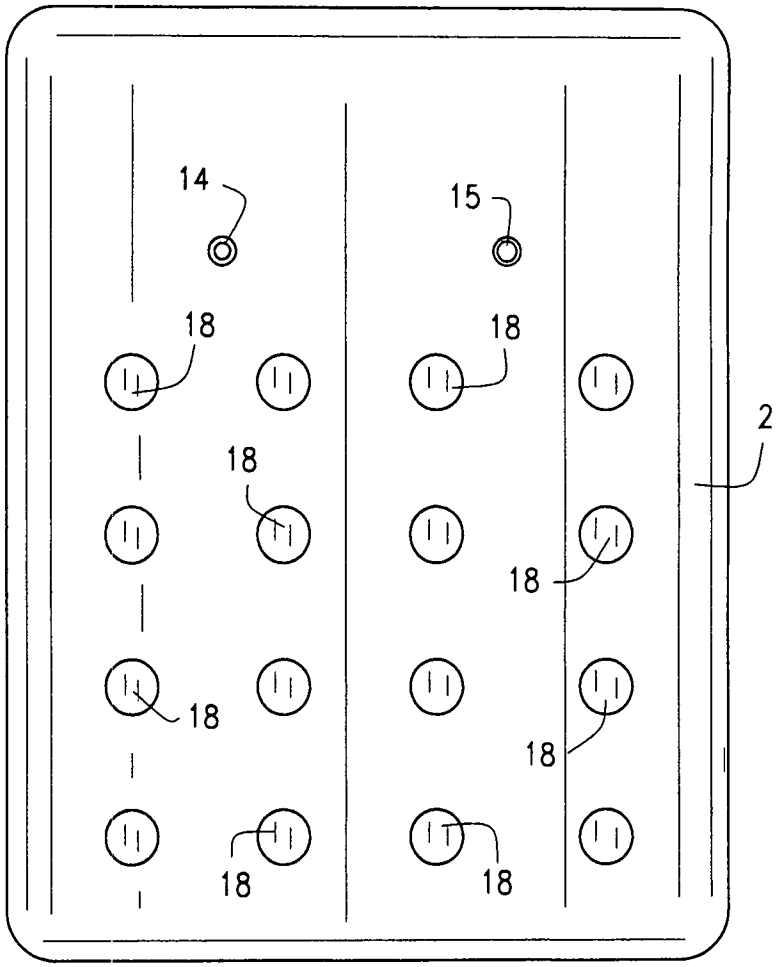
FIG. 7 shows the location of the aligned magnets within the base material, and underneath but aligned with the magnets of the various straps as previously disclosed in FIG. 6.

As can also be seen in FIG. 7, this shows the base material 2 and how the corresponding magnets 18, embedded within the base material 2, are aligned with the magnets located within the various straps 3, as noted in FIG. 6. Thus, when the straps 3 are aligned over the base material, and folded into closure, thereupon, the magnetic attraction between the magnets of the straps 17, and the magnets 18 of the base, hold the straps in position, transversely across the base material for the jewelry case, as can be understood. Furthermore, one can see where the various clasps 14 and 15 are applied to the base material, and to cooperate with similar clasps for the short straps as previously explained with respect to FIG. 4.

Figure 8:
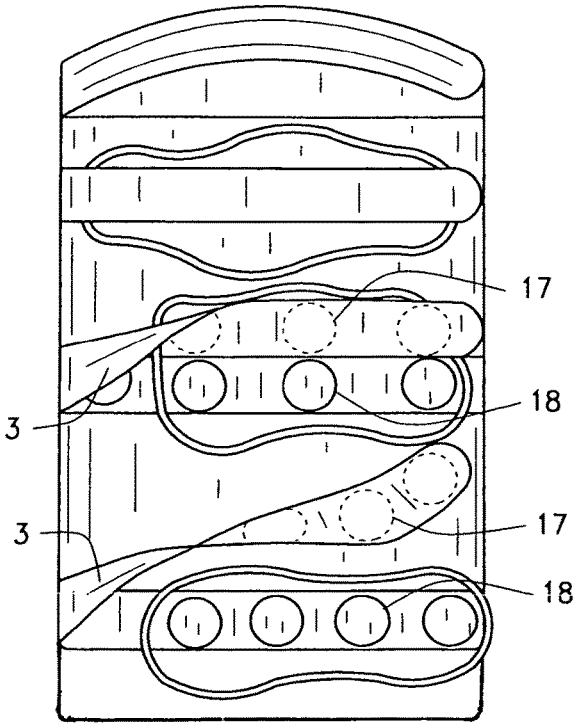
FIG. 8 shows a front view of the jewelry case, in its unrolled position, and disclosing a lifting of select of its straps to show a necklace can be applied into position, locating around a series of fixed magnets, both within the straps, and the base material, in preparation for securement of said necklaces in place, when the straps are applied onto the base material and their magnets hold these two components into fixed position.

The alignment of the various magnets, from these straps, as they are folded over to overlay the base material, can be noted in FIG. 8, wherein the straps 3 are being folded into closure, and their various magnets 17 and 18 are aligned for closure and adherence of the straps to the base material of the device. Note that the straps are connected at one end to an edge of the base material.

Figure 9:
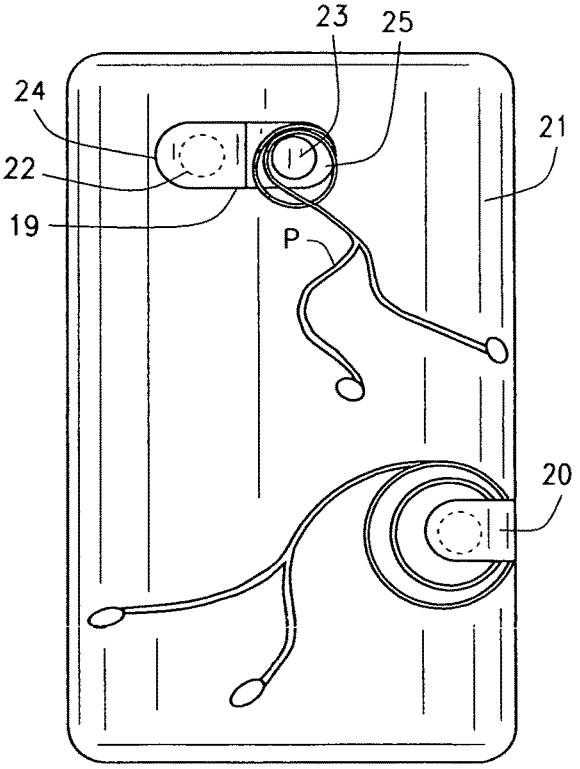
FIG. 9 shows how a small strap may be applied to the front of the base material and can hold various items, such as headphones, and the like, for storage within the jewelry roll or case or on their own as individual straps.

An alternative embodiment for usage of this invention, for holding other accessories, can be seen in FIG. 9. As shown herein, there are a pair of short straps 19 and 20. These are generally adhered to the base material 21 or on their own without a base. There are magnets 22 and 23 that are applied in each half of the short straps 19 and 20, and when the left half of the short strap, as at 24 is folded over onto the short strap segment 25, in the manner as shown for the short strap 20, for example, the wiring for the headphone set, as noted at P, is circularly applied to and around the magnetic 23, so that when the other strap portion 24 is folded over, and its magnet 23 adheres to the aligned magnet on the right side, it can hold the headphone set in a stored position. This can generally be noted with respect to the short strap 20, provided downwardly upon the base material 21 for this storage roll. Strap lengths may vary.

As previously commented, the shape of this particular roll, for most convenient purposes, will be of a square of rectangular design, so as to accommodate its roll up into a storage position. But, it is just as likely that the base material may undertake other shapes, during its fabrication. Furthermore, while the magnets described in these embodiments are shown as being circular, and are a button type of magnet, obviously, they could be of other shapes, such as square, rectangular, or the like. In addition, it could be that, as previously explained, magnetically doped vinyl strips may be applied within the base material, and aligned with similar type of magnetic material provided within the transverse and other straps, so that when an item of jewelry, such as a necklace, is located upon the base material, and a transverse strap is folded over into closure, the magnetic attraction between the two vinyl strips will secure the jewelry in place, during usage of this storage device, whether it be located within the piece of luggage, or simply being conveyed to another location. In addition, the use of magnets can be substituted for other closure materials such as Velcro. These are examples of alternative embodiments that may be used to form the jewelry roll of this invention, as described.

Figure 10:
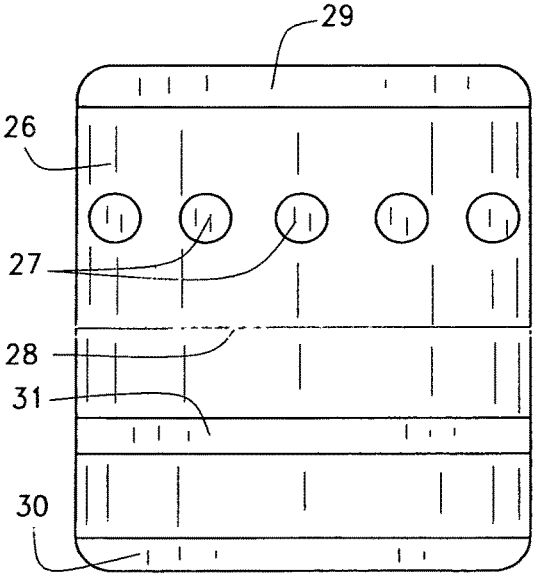
FIG. 10 shows a miniature version of the jewelry case of this invention wherein because of its smaller size, it is of a folded variety to yet hold jewelry but being of lesser size than the rollable type case; and in this instance, one side of the case will connect with the magnets on the other side to keep the jewelry in place. This smaller version acts as one of the straps from the larger version within the bag/case itself and does not require removable straps within it.

As shown in FIG. 10, a jewelry case of a smaller size, and obviously of a lesser cost for manufacture is disclosed. It serves as another option to fit in even smaller bags or purses, for quick trips, such as going to the store, or the gym, where larger size conveying bags are usually not employed. This particular smaller jewelry case, which is of a folded variety, is shown at 26. It includes a series of magnetic buttons, as at 27, and for securing of jewelry components in place, within the shown case. The case includes a fold line 28, provided approximate its center, so that when the case is folded over into closure, an upper magnetic strip 29 or individual magnets secures with a lower magnetic strip or magnets 30 to secure the folded case into closure. A magnetic strip 31 is provided upon the bottom half of the case, and it can also connect with the button magnets 27, when closed, to secure any jewelry placed on or around these magnets.

Figure 11:
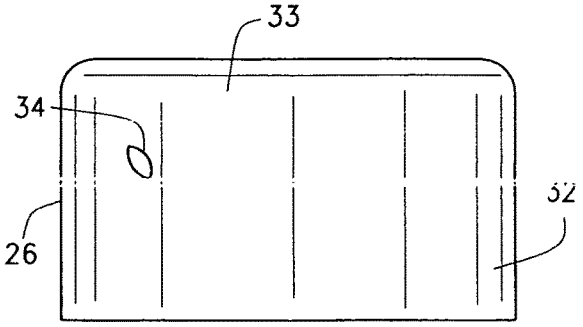
FIG. 11 shows how the upper segment of the foldable case in FIG. 10 can include an invisible pouch, with a closure member, and for carrying other jewelry items.

FIG. 11 shows how, for example, the upper segment of 32 of the case 26 may have a concealed pocket provided internally thereof, and which has an opening, as at 33, through which smaller items of more precious jewelry insert, and be located within the foldable case. A zipper, Velcro, or other form of connector, as at 34 may be provided for securement of the concealed pocket, the entrance, which was identified as at 33, for this segment of the foldable case. This zipper 33 may be what is identified as an invisible zipper.

Figure 12:
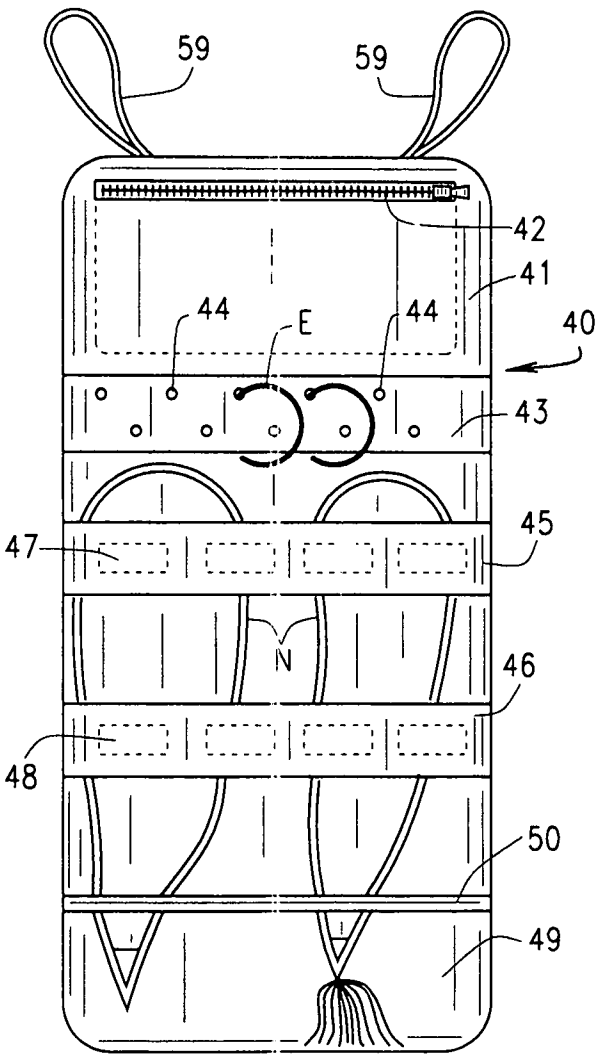
FIG. 12 shows a mini version of the jewelry case of this invention, having a zippered pocket at its upper end, a series of straps containing rectangular or button magnets or Velcro in alignment with magnets located within its base material, and having retaining straps or pouches that can support the lower ends of, for example, necklaces, in position before the fold up of the shown case.

FIG. 12 shows a further embodiment for the foldable style of jewelry case, as noted at 40. It includes a base member 41 which in its upper portion, has a formed pocket, since the base member may be formed of a laminated type of material, to form a pocket internally thereof. A zipper 42 provides for closure of the upper formed pocket. Then, a leather or other material strip, as at 43 is provided, having a series of apertures 44 provided therethrough, and through which earrings, as noted at E, of the pierced type, can be inserted therethrough for retention during usage of the mini version of the jewelry case of this invention.

Then, downwardly therefrom, are a pair of transverse strips of material, as noted at 45 and 46, and these materials may have inserted herein the shown magnets 47 and 48, and which, in the manner as previously described in FIGS. 6-8, will be aligned with similar magnets located within the base material 41, so that when the strips 45 and 46 are pulled free, and necklaces, such as shown at N, are applied therein, and the strips 45 and 46 reapplied, so that their aligned magnets become engaged, will retain the necklaces in place, as can be noted. Obviously, the strip materials 45 and 46 may be secured along one side edge, with the base material 41, so that the strips will be permanently adhered at least along one edge to the base material, in order to maintain the magnet in alignment, when the strips are opened or closed for the application or removal of jewelry therewith or therefrom. As can be seen further, the bottom of the base material may form a pouch 49, having an elastic upper edge 50 and which can be pulled open, for insertion of the lower portions of the necklace's end, therein, to secure them for storage and transit. This is what is identified as a mini version for the jewelry case, and can be either rolled, into closure, or folded into closure, in the manner as previously explained.

Figure 13:
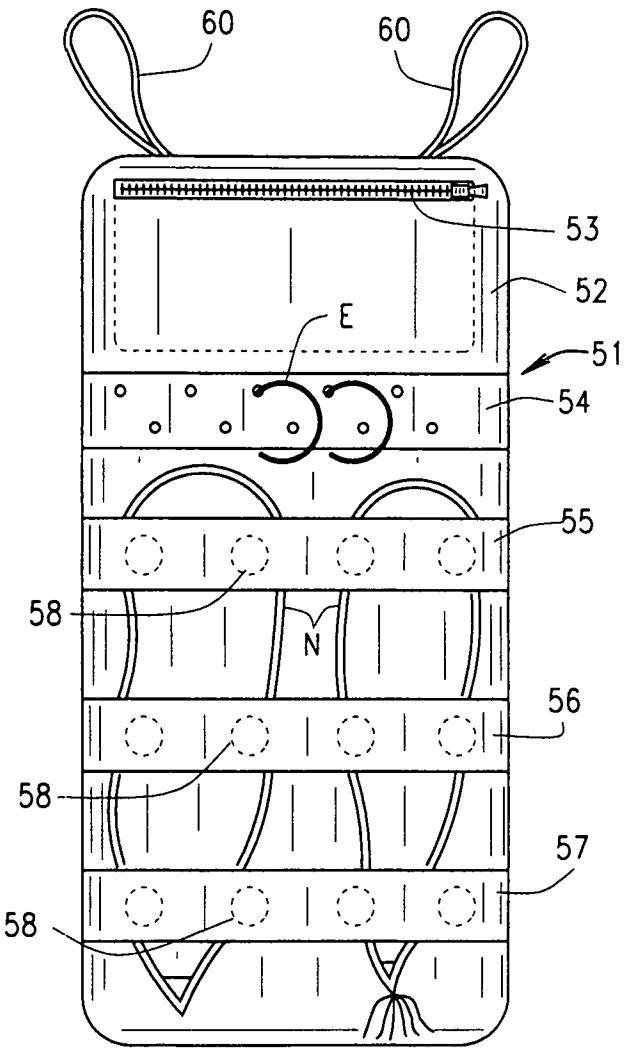
FIG. 13 shows a similar jewelry case as disclosed in FIG. 12, and utilizing various round or rectangular magnets for folding the removable straps from the base material when jewelry is applied therein.

As can be seen in FIG. 13, therein is a very related jewelry case 51 to that as shown in the previous figure. It also includes a base material 52 having the zippered pouch, as at 53, provided at its upper segment, and then has the series of straps 54 for holding the shown earrings E, in addition to three further straps 55, 56 and 57, which include the circular magnets 58 that cooperate with related magnets embedded within the base sheet 52, and which can hold the various necklace's end, in place, when stored as noted. Instead of utilizing a lower pouch, as described at 49 in FIG. 12, this embodiment includes a third strap 57, and its located magnets, that are aligned with similar magnets embedded within the base sheet 52, for securement therewith, when it is desired to hold the necklace's end in place. Obviously, when we describe the various magnets being located within the transfer strips, these strips may be formed of double strip material, in order to embed the magnets therein, and the base sheet 52 may likewise be formed of a pair of sheets, to have the base sheet magnet also embedded therein, adhered in place, and in alignment with the surface magnets of the transfer strips, as noted at 58, and as previously explained herein. This particular mini version for the jewelry case can likewise either be rolled up, or folded, during usage.

Both in FIG. 12 and FIG. 13 it can be seen that there are various elastic length of cords, as noted at 59 and 60, and these are provided for either suspending the opened case, as from a hangar, or a door, during application and usage, or for securing the case into closure, as when it may be rolled up into such closure, or folded into closure, and the attached elastic cords can then be wrapped around the same, to assure closure of the device, and prevent any inadvertent loss of any of the stored jewelry therein.

Figure 14:
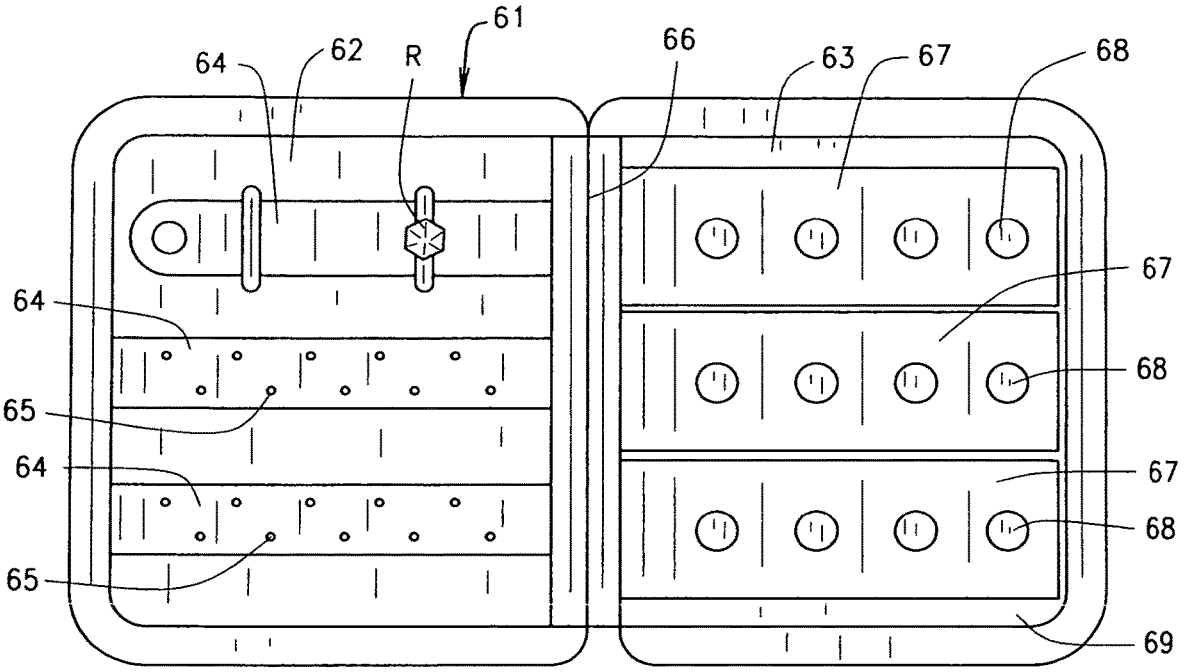
FIG. 14 shows a fold up type of jewelry case incorporating various straps for holding earrings or rings, and other magnetically or Velcro securing straps for holding other items of jewelry within the case.
Figure 15:
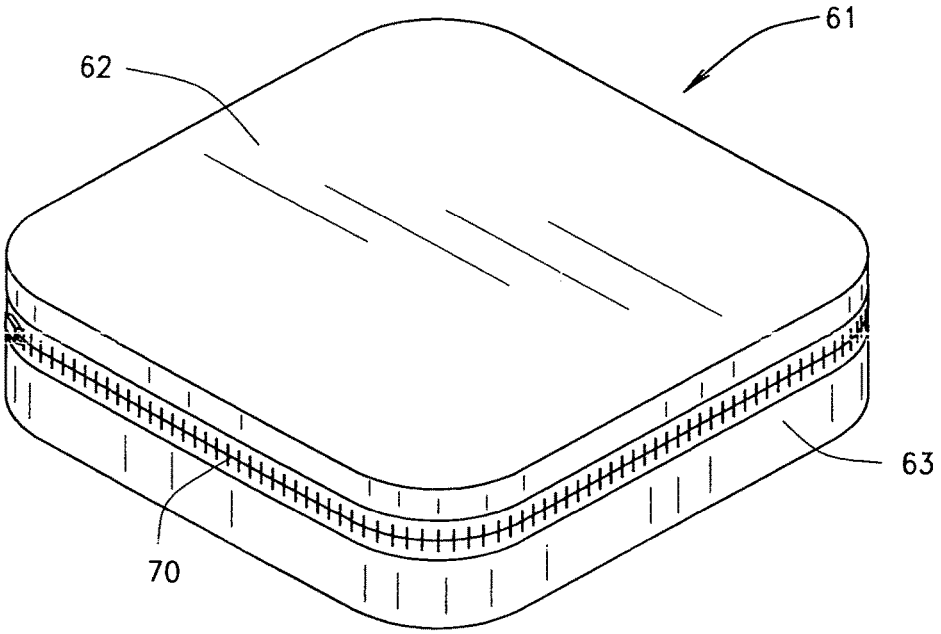
FIG. 15 shows the foldable case from of FIG. 14 being folded and zipped into closure.

FIG. 14 shows a foldable small jewelry case 61 formed of two halves 62 and 63 that have a series of straps 64 provided therein, for holding rings, such as the ring R, or for holding earrings, through the various arranged apertures of 65. These two sides 62 and 63 for the shown case are integrated and connected by a fold line 66 at its midpoint, while the right side of the case includes a series of straps 67, having the magnets 68 provided within the straps, and also having corresponding aligned magnets (not shown) in the outer side 69 of the shown case, such that when the straps are pulled free from their magnetic connection, or Velcro, the jewelry, such as necklaces or bracelets, may be located herein, and held in position by means of the magnet securing straps or Velcro, to hold such in position during usage. FIG. 15 shows how the case 61 can have its two sides 62 and 63, brought into closure, and then a zipper, as at 70, may be located around three sides of the case, and provide for fastening the case into closure, as can be understood. This provides a very compact type of jewelry case, yet applying the magnetic type of straps for securing the jewelry in place, and prevented from cluttering with each other, once secured, and the case closed, in preparation for transit, or storage. But, as can be understood, the type of cases as noted in FIGS. 12 and 13, can be folded to form the case of FIG. 15.

But, as can be noted, the use of magnetic or Velcro straps still serve as an inventive feature on the rollable or foldable jewelry case of this invention. Such connections can be built into the body of the case, and avoid the use of separate straps, particularly with the foldable type, as explained in FIGS. 10 and 11, which obviously makes it more easier of usage by the owner, and at the same time, will help in the reduction of the production cost for the smaller foldable type of case. Nevertheless, the use of magnetic or Velcro straps, all of which may be sewn into place within the various identified cases, and designed to keep jewelry stable, secure, and in place, adds to their security, and prevents any tangling with other components or with itself during travel, or in transit. The magnets can also serve as a closure for the case, particularly in the foldable type, as opposed to the tie and elastic as provided upon the original rollable case, as identified herein.

The size of the foldable case will be similar to that of a wallet, which allows people to carry their jewelry in the smallest of cases, bags, purses, and even clutch purses.

In its assembly, the layers of the foldable case may include an outer faux leather, that holds a zippered pouch on the inner side, generally internally of the upper segment of the shown case, although it could be used and another one applied in the bottom portion of the disclosed case. Magnets are placed on the underside of the fabric forming the case, and can be included with a tape-like adhesive or fusing, and then a soft, micro/eco/suede material goes on the inside to protect the enclosed and encased jewelry. The smaller versions may also be made of silicone, rubber, or plastic.

Variations and modifications to the subject matter of this invention may occur to those skilled in the art upon review of the invention as described herein. Such variations, if within the spirit of this invention, are intended to be encompassed within the scope of any claims to patent protection issuing herein. The definition of the invention within the preferred embodiments, and its depiction in the drawings, are generally set forth for illustrative purposes only. Any equivalent structures, that function in the manner as described for the current invention, are intended to be encompassed within the scope of any claims obtained.

I claim:

1. A compact jewelry case comprising a base member and which may be rolled up or folded for storage or transit when not in usage:

said jewelry case formed of base material, said base material being a double layer of material, said base material having a pair of oppositely disposed lateral edges, and said base material having upper and lower edges, a series of transverse straps provided substantially horizontally across the base material from one lateral edge to the other lateral edge, said transverse straps having ends, and one end of each strap being secured to a lateral edge of said base material, said transverse straps having magnetic material located, therein, magnetic material also located between the double layer of base material, with said base material having space intermediately thereof to hold the magnetic material in place, said magnetic material being individual magnets, with said magnets in the transverse straps and in the base material being aligned, so that when the straps are folded over into closure the magnets are aligned to secure any jewelry that is applied upon the base material and held into position by the magnets of the straps into closure upon said base material, whereby folding or rolling of said base material perpendicularly with respect to said horizontal straps forms a compact jewelry case enclosure, wherein each strap holding a magnet has a matting applied interiorly thereof, over laying the base material magnets, so as to prevent the magnets of each strap from adhering to each other when the jewelry case is unrolled into an open position, and a pair of elastic cords provided proximate the upper and lower edges of the base material, and said elastic cords provided for wrapping around the ends of the rolled up jewelry case to secure it into its rolled position, during storage or transit.

2. The jewelry case of claim 1, wherein there are a pair of short straps extending partially across the base material, one of such short straps holds earrings in place, while the other short strap secures rings to the jewelry case during usage.

3. The jewelry case of claim 2, wherein the short strap holding rings has stuffing material applied therein, in order to secure the rings upon the short strap when it is secured into closure upon the base material.

4. The jewelry case of claim 1, wherein said closure means comprises a zipper.

5. The jewelry case of claim 4, and a cover provided upon the zipper to conceal said zipper and the concealed pocket from view.

6. The jewelry case of claim 1, and including a tie means provided connecting with the upper edge of the base material, and provided for tying of the unrolled jewelry case onto a support during usage.

7. The jewelry case of claim 1, and including a pair of elastic cords provided laterally along the upper edge of the base material, and said elastic cords provided for application to a hanger for support of the unfolded jewelry case during usage.

8. The jewelry case of claim 1, wherein the folded jewelry case has an upper segment, and a lower segment, with a fold line provided approximately transversely at the midpoint of the jewelry case, so that the jewelry case can be folded over into closure.

9. The jewelry case of claim 1, wherein at least one of the upper and lower segments of the foldable jewelry case contains a pocket provided therein, for insertion and securement of smaller jewelry items therein, during usage.

10. The jewelry case of claim 9, wherein the pocket has an opening provided therein, to allow for entrance of jewelry therein, and said pocket opening having a closure, of one of a zipper, hook and pile fastener, or clasp, to hold the pocket into closure when smaller items of jewelry have been inserted therein.

11. The jewelry case of claim 1, and including fastener means provided around the edges of the formed folded jewelry case, to secure the case into closure.

12. The jewelry case of claim 11, wherein said fastener means comprises a zipper.

13. The jewelry case of claim 1, wherein said magnetic material comprises individual magnets.

* * * * *